US011305342B2

(12) United States Patent
Ogyu

(10) Patent No.: US 11,305,342 B2
(45) Date of Patent: Apr. 19, 2022

(54) CASTING DEVICE

(71) Applicant: SINTOKOGIO, LTD., Nagoya (JP)

(72) Inventor: Tsukasa Ogyu, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 73 days.

(21) Appl. No.: 16/967,609

(22) PCT Filed: Feb. 20, 2019

(86) PCT No.: PCT/JP2019/006342
§ 371 (c)(1),
(2) Date: Aug. 5, 2020

(87) PCT Pub. No.: WO2019/198346
PCT Pub. Date: Oct. 17, 2019

(65) Prior Publication Data

US 2021/0268579 A1 Sep. 2, 2021

(30) Foreign Application Priority Data

Apr. 11, 2018 (JP) ..... JP2018-076308

(51) Int. Cl.
*B22D 33/02* (2006.01)
*B22C 9/06* (2006.01)
*B22D 23/00* (2006.01)

(52) U.S. Cl.
CPC ..... *B22D 33/02* (2013.01); *B22C 9/06* (2013.01); *B22C 9/062* (2013.01); *B22D 23/006* (2013.01)

(58) Field of Classification Search
CPC ..... B22D 33/02; B22D 33/04; B22D 41/04; B22D 41/06; B22D 23/006
See application file for complete search history.

(56) References Cited

U.S. PATENT DOCUMENTS 10,201,851 B2 * 2/2019 Funakoshi ..... B22D 23/006

FOREIGN PATENT DOCUMENTS

| | | | |
|---|---|---|---|
| JP | H04-187365 | A | 7/1992 |
| JP | 2004-268082 | A | 9/2004 |
| JP | 2007-83293 | A | 4/2007 |
| JP | 5880792 | B1 | 3/2016 |

OTHER PUBLICATIONS

International Preliminary Report on Patentability dated Oct. 22, 2020 for PCT/JP2019/006342.

* cited by examiner

*Primary Examiner* — Kevin E Yoon
*Assistant Examiner* — Jacky Yuen
(74) *Attorney, Agent, or Firm* — Faegre Drinker Biddle & Reath LLP

(57) ABSTRACT

A casting apparatus according to the present disclosure includes an upper frame, a lower frame, a main link member, a sub-link member and a lifting/lowering mechanism. The upper mold is attached to the upper frame. The lower frame is disposed in parallel with the upper frame. The lower mold is attached to the lower frame. A top end part of the main link member is rotatably connected to the upper frame and a bottom end part thereof is rotatably connected to the lower frame. The sub-link member is disposed in parallel with the main link member, the top end part thereof is rotatably connected to the upper frame and the bottom end part thereof is rotatably connected to the lower frame. The lifting/lowering mechanism causes the sub-link member to lift or lower with respect to the main link member.

4 Claims, 15 Drawing Sheets

CASTING DEVICE

TECHNICAL FIELD

The present disclosure relates to a casting apparatus.

BACKGROUND ART

Patent Literature 1 discloses a gravity type tilting die casting apparatus. This apparatus is provided with an upper frame, a lower frame, a main link member, a sub-link member and a drive unit. An upper mold is attached to the upper frame. A lower mold is attached to the lower frame. A top end part of the main link member is rotatably connected to the upper frame, and a bottom end part of the first main link member is rotatably connected to the lower frame. The sub-link member is rotatably connected to the upper frame, and a bottom end part of the first sub-link member is rotatably connected to the lower frame. The drive unit is connected to the rotating shaft of the main link member and rotates the first main link member around the rotating shaft. The upper frame and the lower frame are disposed in parallel with each other, the first main link member and the first sub-link member are disposed in parallel with each other, and the upper frame, the lower frame, the first main link member and the first sub-link member constitute a first parallel link mechanism. The upper mold and the lower mold can be separated in a horizontal direction by rotating the first main link member with the upper mold and the lower mold opened.

CITATION LIST

Patent Literature

Patent Literature 1: Japanese Patent No. 5880792

SUMMARY OF INVENTION

Technical Problem

In the casting apparatus, a lower part of the upper mold and an upper part of the lower mold are opened by separating the upper mold and the lower mold in the horizontal direction. However, since the upper mold is facing down, maintenance work on the upper mold cannot be performed easily.

For this reason, in the present technical field, it is expected that maintenance work on the upper mold and the lower mold be performed more easily.

Means for Solving the Problems

A casting apparatus according to an aspect of the present disclosure forms a casting by using openable/closable/tiltable upper and lower molds, with molten metal being poured into the casting apparatus by using gravity. The casting apparatus includes an upper frame, a lower frame, a main link member, a sub-link member, and a lifting/lowering mechanism. The upper mold is attached to the upper frame. The lower frame is disposed in parallel with the upper frame. The lower mold is attached to the lower frame. A top end part of the main link member is rotatably connected to the upper frame and a bottom end part thereof is rotatably connected to the lower frame. The sub-link member is disposed in parallel with the main link member, the top end part of which is rotatably connected to the upper frame and the bottom end part of which is rotatably connected to the lower frame. The lifting/lowering mechanism causes the sub-link member to lift or lower with respect to the main link member.

The casting apparatus includes the lifting/lowering mechanism lifting or lowering the sub-link member with respect to the main link member. The main link member and the sub-link member are rotatably connected to the upper frame and the lower frame respectively. Therefore, when the lifting/lowering mechanism causes the sub-link member to lift or lower, the upper frame and the lower frame are tilted. Accordingly, the upper mold and the lower mold attached to the upper frame and the lower frame, respectively, are tilted. Therefore, if the upper mold and the lower mold are tilted with the upper mold and the lower mold opened, it is possible to facilitate maintenance work on the upper mold and the lower mold.

The casting apparatus may further include a drive unit connected to the main link member and causing the main link member to rotate. In this case, compared to the case where the lifting/lowering mechanism causes the main link member to which the drive unit is connected to lift or lower, a load on the lifting/lowering mechanism can be reduced.

The casting apparatus may further include a connection member including a first part and a second part. The main link member may include a tilt rotating shaft at a central part of the main link member. The first part may be rotatably connected to the tilt rotating shaft. The second part may be rotatably connected to the central part of the sub-link member. The lifting/lowering mechanism may be connected to the second part to cause the second part to rotate around the tilt rotating shaft and thereby lift or lower the sub-link member with respect to the main link member. In this case, since a force of the lifting/lowering mechanism is directly given to the second part of the connection member, the second part can be rotated stably.

Advantageous Effect of the Invention

According to the present disclosure, it is possible to facilitate maintenance work on the upper mold and the lower mold.

DESCRIPTION OF EMBODIMENTS

Figure 1:
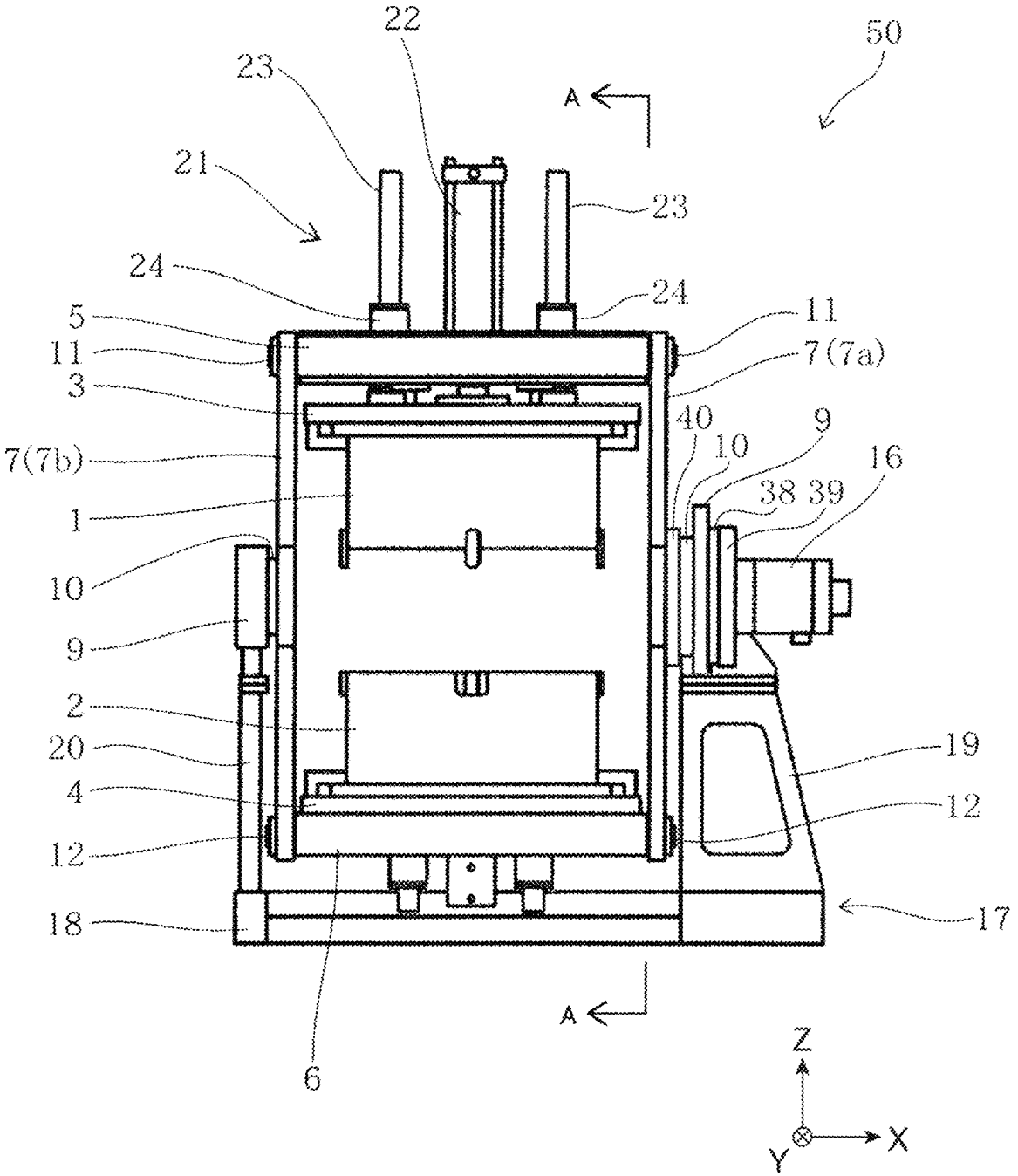
FIG. 1 is a front view of a casting apparatus according to a first embodiment.

Hereinafter, embodiments of the present invention will be described with reference to the accompanying drawings. The same elements in description of the drawings are assigned the same reference numerals and duplicate description thereof will be omitted. Dimensional ratios among the drawings do not always correspond to those in the description. Terms like "up," "down," "left" and "right" are based on the illustrated states and used for conveniences sake.

First Embodiment

Figure 2:
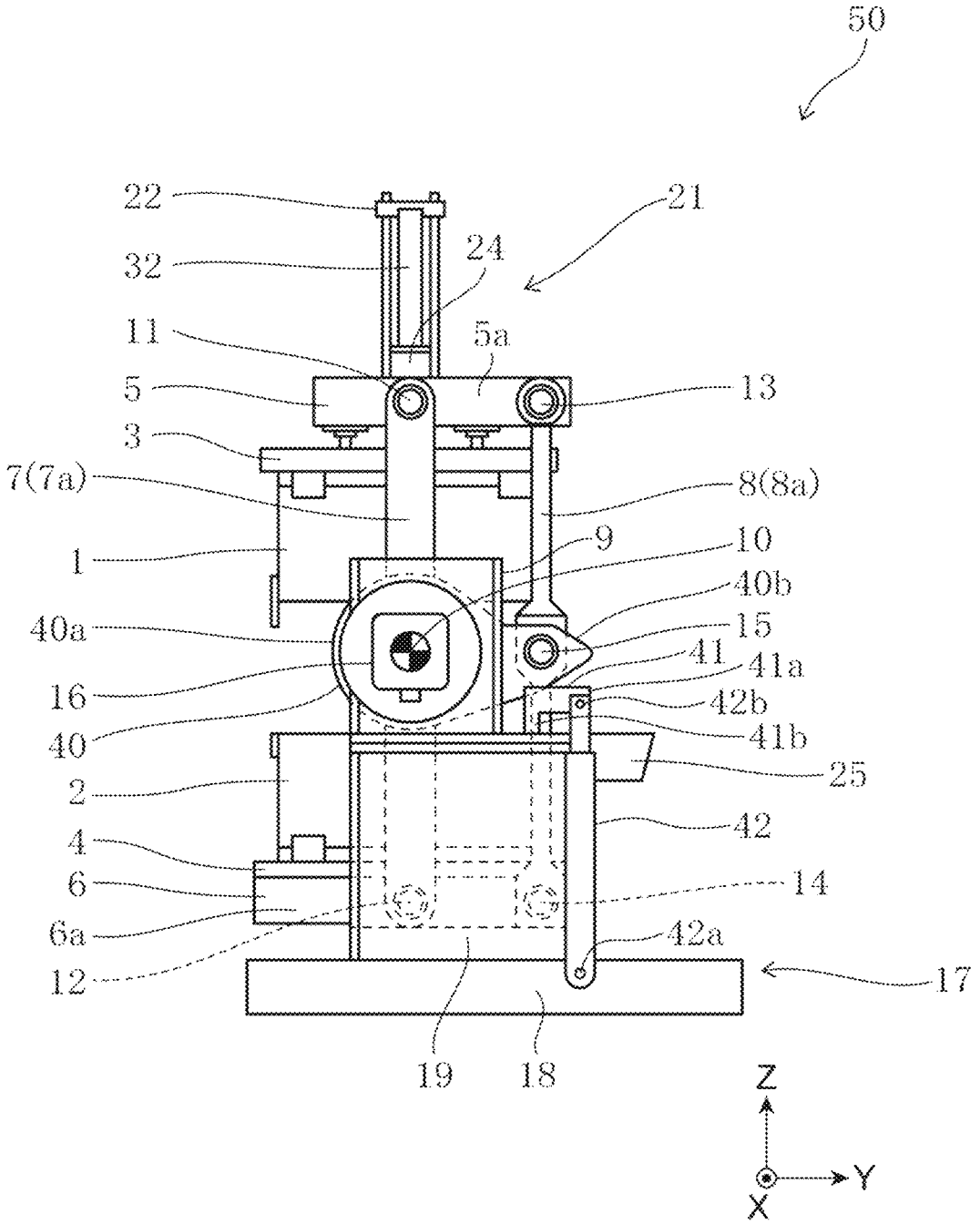
FIG. 2 is a side view of the casting apparatus in FIG. 1.

A configuration of a casting apparatus 50 according to the first embodiment will be described with reference to FIG. 1 and FIG. 2. FIG. 1 is a front view of a casting apparatus according to a first embodiment. FIG. 2 is a side view of the casting apparatus in FIG. 1. An X direction and a Y direction in the drawings are horizontal directions and a Z direction is a vertical direction. Hereinafter, the X direction will also be referred to as a left-right direction and the Z direction will also be referred to as an up-down direction.

The casting apparatus 50 is a so-called gravity type tilting die casting apparatus into which molten metal is poured using gravity and which forms a casting using an upper mold 1 and a lower mold 2 which can be opened, closed and tilted. The molten metal to be poured can be any material. Examples of the molten metal to be used include aluminum alloy and magnesium alloy. The casting apparatus 50 includes a controller and is configured to be able to control operations of respective components.

As shown in FIG. 1 and FIG. 2, the casting apparatus 50 is provided with, for example, a base frame 17, an upper frame 5, a lower frame 6, an opening/closing mechanism 21, a pair of left and right main link members 7 (first main link member 7*a*, second main link member 7*b*), a pair of left and right sub-link members 8 (first sub-link member 8*a*, second sub-link member 8*b*), a rotation actuator 16 (drive unit), a bracket 40 (connection member), a fixing member 41, a lifting/lowering mechanism 42 and a ladle 25.

The base frame 17 includes a base 18, a drive-side support frame 19 and a driven-side support frame 20. The base 18 is a substantially flat plate member composed by combining a plurality of members and is provided horizontally on an installation surface of the casting apparatus 50. The drive-side support frame 19 and the driven-side support frame 20 are vertically disposed in such a way as to oppose each other in a left-right direction (horizontal direction) on the base 18 and are fixed to the base 18. A pair of tilting rotation bearings 9 are provided at a top end part of the drive-side support frame 19 and at a top end part of the driven-side support frame 20.

The upper frame 5 is disposed above the base frame 17. The upper mold 1 is attached to the upper frame 5. More specifically, the upper mold 1 is mounted on an undersurface of the upper frame 5 via an upper mold die base 3. The upper frame 5 is provided with the opening/closing mechanism 21 moving the upper mold 1 up and down. More specifically, the upper frame 5 incorporates the opening/closing mechanism 21 and holds the upper mold 1 in such a way as to be movable up and down through the opening/closing mechanism 21.

The opening/closing mechanism 21 includes a first hydraulic actuator 22, a pair of left and right guide rods 23 and a pair of left and right guide cylinders 24. The first hydraulic actuator 22 moves either the upper mold 1 or the lower mold 2 up and down to thereby open or close the upper mold 1 and the lower mold 2. In the present embodiment, the first hydraulic actuator 22 moves the upper mold 1 up. A bottom end part of the first hydraulic actuator 22 is mounted on a top surface of the upper mold die base 3. The first hydraulic actuator 22 extends in an up-down direction (vertical direction; Z direction here) to thereby move the upper mold 1 down via the upper mold die base 3, and is contracted in the up-down direction to thereby move the upper mold 1 up via the upper mold die base 3. An example of the first hydraulic actuator 22 is a hydraulic cylinder. The guide rods 23 are mounted on the top surface of the upper mold die base 3 through the guide cylinder 24 mounted on the upper frame 5.

The lower frame 6 is disposed in parallel with the upper frame 5. The lower frame 6 is disposed above the base frame 17 and below the upper frame 5. The lower mold 2 is attached to the lower frame 6. More specifically, the lower mold 2 is mounted on a top surface of the lower frame 6 via a lower mold die base 4. In the state shown in FIG. 1 and FIG. 2, the upper frame 5 and the lower frame 6 face each other in the up-down direction. Similarly, the upper mold 1 and the lower mold 2 face each other in the up-down direction. The opening/closing mechanism 21 moves the upper mold 1 up and down to thereby close or open the upper mold 1 and the lower mold 2.

The first main link member 7*a* is an elongated member. The first main link member 7*a* is, for example, a rod-like member having a rectangular cross section. A top end part of the first main link member 7*a* is rotatably connected to the upper frame 5. A bottom end part of the first main link member 7*a* is rotatably connected to the lower frame 6. The first main link member 7*a* includes a tilt rotating shaft 10 at a central part thereof. The first main link member 7*a* includes a main link upper rotating shaft 11 at a top end part thereof and a main link lower rotating shaft 12 at a bottom end part thereof. In the present embodiment, a pair of main link members 7 are provided. The second main link member 7*b* has the same configuration as that of the first main link member 7*a*. The pair of main link members 7 are arranged in such a way as to face each other in the left-right direction (horizontal direction; X direction here). The pair of main link members 7 connect the upper frame 5 and the lower frame 6 respectively. Here, the pair of main link members 7 are arranged in parallel in such a way as to face each other across the upper mold 1 and the lower mold 2.

The central parts of the pair of main link members 7 are rotatably connected to the pair of tilting rotation bearings 9 via the pair of tilt rotating shafts 10. The top end parts of the pair of main link members 7 are rotatably connected to a pair of side faces 5*a* of the upper frame 5 via the pair of main link upper rotating shafts 11. The bottom end parts of the pair of main link members 7 are rotatably connected to a pair of side faces 6*a* of the lower frame 6 via the pair of main link lower rotating shafts 12. When the upper mold 1 and the lower mold 2 are closed, the mounting positions of the pair of main link members 7 with respect to the upper frame 5 and the lower frame 6 are set so that the pair of main link members 7 are located at the respective centers of the upper mold 1 and the lower mold 2 in a depth direction (Y direction) orthogonal to the left-right direction and the up-down direction.

The first sub-link member 8*a* is a long member. The first sub-link member 8*a* is, for example, a bar-like member having a rectangular cross section. The first sub-link member 8*a* is disposed in parallel with the first main link member 7*a*. A top end part of the first sub-link member 8*a* is rotatably connected to the upper frame 5. A bottom end part of the first sub-link member 8*a* is rotatably connected to the lower frame 6. The first sub-link member 8*a* includes a sub-link central part rotating shaft 15 at a central part thereof. The first sub-link member 8*a* includes a sub-link upper rotating shaft 13 at a top end part thereof and a sub-link lower rotating shaft 14 at a bottom end part thereof. In the present embodiment, a pair of sub-link members 8 are provided. The second sub-link member 8*b* (not shown) has the same configuration as that of the first sub-link member 8*a*. The pair of sub-link members 8 are arranged in such a way as to face each other in the left-right direction, and connect the upper frame 5 and the lower frame 6. The pair of sub-link members 8 are provided on a pair of side faces 5*a* and a pair of side faces 6*a* in such a way as to be in parallel with the pair of main link members 7. The sub-link member 8 has the same length as that of the main link member 7.

The top end parts of the pair of sub-link members 8 are rotatably connected to the pair of side faces 5*a* of the upper frame 5 via the pair of sub-link upper rotating shafts 13. The bottom end parts of the sub-link members 8 are rotatably connected to the pair of side faces 6*a* of the lower frame 6 via a pair of sub-link lower rotating shafts 14. The mounting position of the sub-link member 8 is on a side where the ladle 25 is disposed with respect to the main link member 7. The sub-link central part rotating shaft 15 is disposed on the drive-side support frame 19.

Thus, the upper frame 5 and the lower frame 6 are disposed in parallel with each other, and the first main link member 7*a* and the first sub-link member 8*a* are disposed in parallel with each other, and thus, the upper frame 5, the lower frame 6, the first main link member 7*a* and the first sub-link member 8*a* constitute a parallel link mechanism. Similarly, the upper frame 5 and the lower frame 6 are disposed in parallel with each other, and the second main link member 7*b* and the second sub-link member 8*b* are disposed in parallel with each other, and so the upper frame 5, the lower frame 6, the second main link member 7*b* and the second sub-link member 8*b* constitute a parallel link mechanism. The two parallel link mechanisms are disposed in parallel with each other and in such a way as to oppose each other across the upper mold 1 and the lower mold 2.

The tilt rotating shaft 10 of the first main link member 7*a* is held on the base frame 17 by the tilting rotation bearing 9 provided outside the first parallel link mechanism. The center of rotation of the tilt rotating shaft 10 of the first main link member 7*a* coincides with the center of gravity of a rotation body including the closed or opened upper mold 1 and lower mold 2, and the upper frame 5 and the lower frame 6. Similarly, the tilt rotating shaft 10 of the second main link member 7*b* is held on the base frame 17 by the tilting rotation bearing 9 provided outside the second parallel link mechanism. The center of rotation of the tilt rotating shaft 10 of the second main link member 7*b* coincides with the center of gravity of the rotation body including the closed or opened upper mold 1 and lower mold 2, and the upper frame 5 and the lower frame 6. Here, "coincide" is not limited to a case where both coincide completely, but includes a case where errors are contained due to a difference between the weight of the upper mold 1 and the weight of the lower mold 2.

The rotation actuator 16 is disposed on the drive-side support frame 19. The rotation actuator 16 is connected to one of the pair of main link members 7 and causes the one of the pair of main link members 7 to rotate. In the present embodiment, the rotation actuator 16 is connected to of the first main link member 7*a* and causes the first main link member 7*a* to rotate. The rotation actuator 16 is provided in such a way as to be connected to the tilt rotating shaft 10 of the first main link member 7*a* via a reduction gear 38. The reduction gear 38 is attached to the tilt rotating shaft 10 via a bracket 39. The rotation actuator 16 may be operated by any one of electric motor, hydraulic pressure and pneumatic pressure. An example of the rotation actuator 16 is a servo motor. The servo motor is connected to a power supply and operates when supplied with power. The rotation actuator 16 causes the first main link member 7*a* to rotate and thereby functions as a drive unit tilting the upper mold 1 and the lower mold 2 or separating the upper mold 1 from the lower mold 2 in the horizontal direction.

The upper mold 1 and the lower mold 2 are tilted when the rotation actuator 16 rotates the tilt rotating shaft 10 of the first main link member 7*a* by 45° to 130° with the upper mold 1 and the lower mold 2 closed by the opening/closing mechanism 21. The upper mold 1 is separated from the lower mold 2 in the horizontal direction when the rotation actuator 16 causes the tilt rotating shaft 10 of the first main link member 7*a* to rotate by a predetermined angle with the upper mold 1 and the lower mold 2 closed by the opening/closing mechanism 21. Separation of the upper mold 1 from the lower mold 2 in the horizontal direction is realized by the rotation actuator 16 causing the first parallel link mechanism to act. At this time, the second parallel link mechanism also acts in accordance with the movement of the first parallel link mechanism. The second parallel link mechanism is not essential. The upper frame 5 and the lower frame 6 may be connected by, for example, only the first parallel link mechanism and the second main link member 7*b*. The upper frame 5 and the lower frame 6 may be connected by only the first parallel link mechanism and the second sub-link member 8*b*.

The bracket 40 is disposed outside the first main link member 7*a* and the first sub-link member 8*a* and inside the tilting rotation bearing 9. The bracket 40 includes a first part 40*a* and a second part 40*b*. The first part 40*a* and the second part 40*b* are integrally formed. The first part 40*a* and the second part 40*b* are arranged along a direction parallel to the upper frame 5 and the lower frame 6. The first part 40*a* is rotatably connected to the central part of the first main link member 7*a*. The second part 40*b* is rotatably connected to the central part of the first sub-link member 8*a*.

More specifically, the first part 40*a* is rotatably connected to the tilt rotating shaft 10. The first part 40*a* is attached to the tilt rotating shaft 10 via a bearing such as a cross roller ring. More specifically, the second part 40*b* is rotatably connected to the sub-link central part rotating shaft 15. The first part 40*a* is attached to the sub-link central part rotating shaft 15 via a bearing such as a cross roller ring.

The fixing member 41 is fixed to a bottom end of the second part 40*b* of the bracket 40. The fixing member 41 is, for example, an L-shaped member. A top end part of the lifting/lowering mechanism 42 is rotatably connected to one end part 41*a* of the fixing member 41. In the states in FIG. 1 and FIG. 2, the other end part 41*b* of the fixing member 41 is placed on the top surface of the drive-side support frame 19. The sub-link central part rotating shaft 15 is supported by the drive-side support frame 19 via the bracket 40 and the fixing member 41.

The lifting/lowering mechanism 42 lifts or lowers the first sub-link member 8*a* with respect to the first main link member 7*a*. Operation of the lifting/lowering mechanism 42 will be described later. The lifting/lowering mechanism 42 is, for example, a hydraulic cylinder. A bottom end part of the lifting/lowering mechanism 42 is connected to the base 18 of the base frame 17. A rotating shaft 42*a* is provided at a bottom end part of the lifting/lowering mechanism 42. The lifting/lowering mechanism 42 is connected to the base 18 in such a way as to be rotatable around the rotating shaft 42*a*. A top end part of the lifting/lowering mechanism 42 (distal end part of the hydraulic cylinder rod) is connected to the one end part 41*a* of the fixing member 41. A rotating shaft 42*b* is provided at a top end part of the lifting/lowering mechanism 42. The lifting/lowering mechanism 42 is connected to the fixing member 41 in such a way as to be rotatable around the rotating shaft 42*b*. Since the fixing member 41 is fixed to the second part 40*b* of the bracket 40, the lifting/lowering mechanism 42 can be said to be connected to the second part 40*b* via the fixing member 41.

The ladle 25 is mounted at a top end part of the side face of the lower mold 2. A storage part for storing molten metal is formed in the ladle 25. A pouring port 25*a* (see FIG. 5) of the ladle 25 is connected to a receiving port 2*a* of the lower mold 2 (see FIG. 5).

Figure 3:
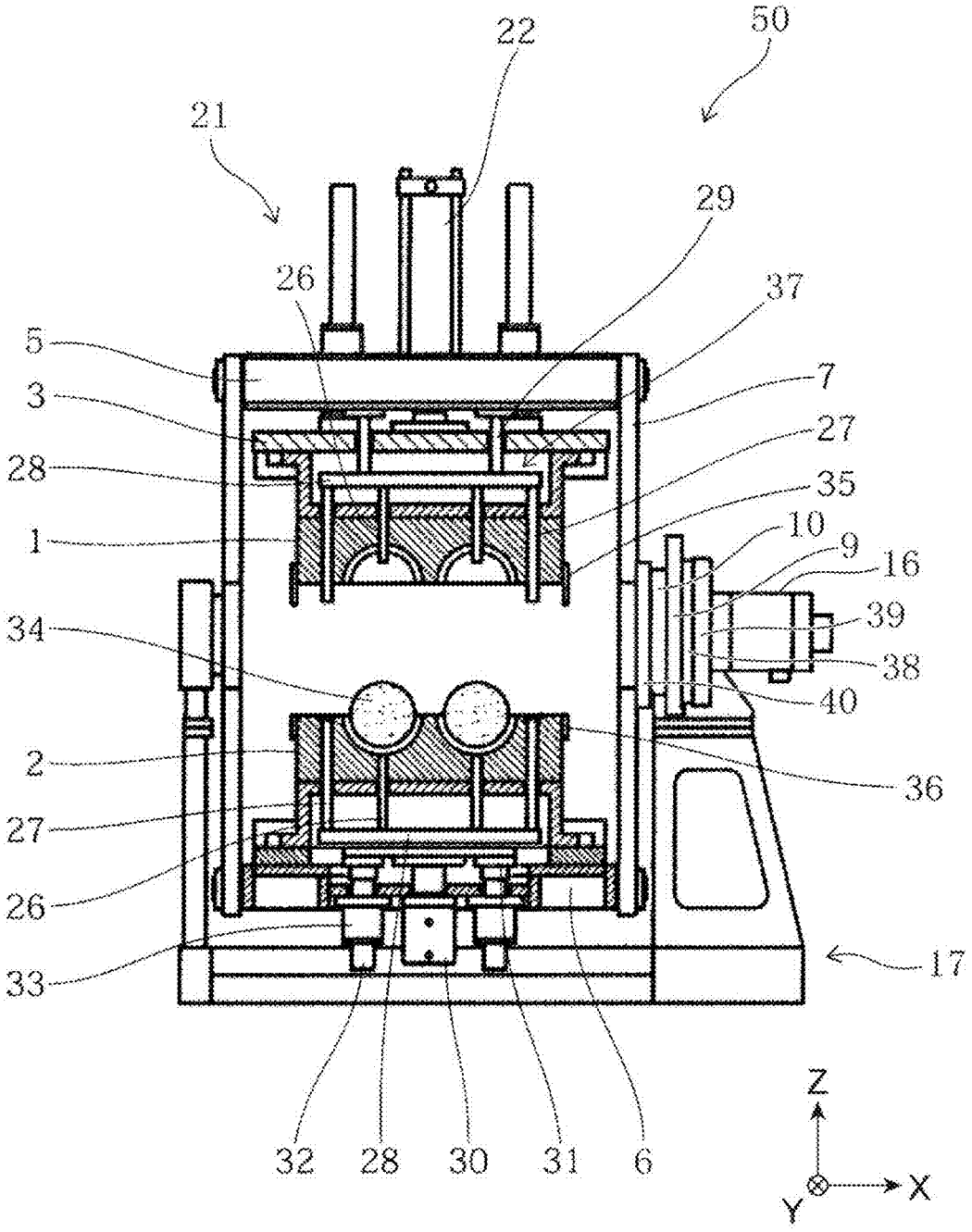
FIG. 3 is a diagram illustrating a cross section of an upper mold and a lower mold in FIG. 1.

FIG. 3 is a diagram illustrating cross sections of the upper mold and the lower mold in FIG. 1. Here, a state is shown in which a plurality of cores 34 are fitted on a top surface of the lower mold 2. As shown in FIG. 3, the casting apparatus 50 is provided with a pushing out mechanism 37 including a pushing out plate 28 (upper pushing out plate), a pair of pushing out pins 26 (upper pushing out pin), a pair of return pins 27 and a plurality of push rods (regulating member) 29. The pushing out mechanism 37 is provided in the upper frame 5.

The pushing out plate 28 is disposed in an inner space formed in the interior on a top end side of the upper mold 1. The pushing out plate 28 is fitted in the inner space in such a way as to be freely movable up and down. Each pushing out pin 26 is provided on an undersurface of the pushing out plate 28. Each pushing out pin 26 moves up and down through a hole from the inner surface of the upper mold 1 to a cavity (upper cavity) in which a casting is formed. Each pushing out pin 26 pushes out the casting in the cavity by a distal end thereof. Each return pin 27 is provided at a position of the pushing out plate 28 different from the pushing out pin 26 of the undersurface. Each return pin 27 moves up and down through the hole from the inner space of the upper mold 1 to an undersurface of the upper mold 1. Each return pin 27 causes the pushing out plate 28 to move up when the distal end of the return pin 27 abuts against the top surface of the lower mold 2 in a process in which the upper mold 1 and the lower mold 2 are closed.

Each push rod 29 is provided on the undersurface of the upper frame 5. Each push rod 29 is disposed on the undersurface of the upper frame 5 by penetrating the upper mold die base 3. The distal end of each push rod 29 is disposed above the pushing out plate 28 into the inner space with each push rod 29 inserted into the hole from the top surface of the upper mold 1 to the inner space. The length of each push rod 29 is set to a length at which the pushing out plate 28 is pushed down when the first hydraulic actuator 22 is contracted and the upper mold 1 reaches an ascending end. The ascending end is a highest possible position of the upper mold 1 as the first hydraulic actuator 22 is contracted. That is, each push rod 29 passes through the hole from the top surface of the upper mold 1 into the inner space formed at a position above the upper mold 1 entering the inner space by a predetermined length to thereby prevent the pushing out plate 28 from moving up.

The lower frame 6 incorporates a second hydraulic actuator 30. An example of the second hydraulic actuator 30 is a hydraulic cylinder. A top end part of the second hydraulic actuator 30 is mounted on an undersurface of the pushing out member 31. A pair of left and right guide rods 32 pass through guide cylinders 33 attached to the lower frame 6 and are mounted on the undersurface of the pushing out member 31.

Just like the upper mold 1, the lower mold 2 incorporates the pushing out plate 28 (lower pushing out plate) to which the pair of pushing out pins 26 (lower pushing out pins) and the pair of return pins 27 are connected. There is such a positional relationship in the lower mold 2 that the pushing out member 31 moves up by extending operation of the second hydraulic actuator 30 to push up the pushing out plate 28 and the pair of pushing out pins 26 and the return pins 27 move up. The distal end of each pushing out pin 26 pushes out a casting in a cavity (lower cavity). The return pins 27 of the upper mold 1 and the lower mold 2 are pushed back at the time of mold closing, by a mating surface of the mold opposite to the distal ends of the return pins 27 or the distal ends of the opposite return pins 27. Accordingly, the pushing out pin 26 connected to the pushing out plate 28 is also pushed back. At the time of mold closing, contraction operation of the second hydraulic actuator 30 causes the pushing out member 31 to reach a descending end position. The descending end refers to a lowest possible position of the lower mold 2 as the second hydraulic actuator 30 is contracted.

A pair of positioning keys 35 are mounted in the lower periphery (side face bottom end part) of the upper mold 1. A pair of key grooves 36 are provided in the upper periphery (side face top end part) of the lower mold 2 in such a way as to be engageable with the pair of positioning keys 35. The positioning keys 35 and the key grooves 36 constitute a positioning unit for positioning the upper mold 1 and the lower mold 2 in the horizontal direction. According to this positioning unit, since the upper mold 1 and the lower mold 2 are positioned in the horizontal direction, it is possible to prevent the upper mold 1 and the lower mold 2 from being displaced and closed.

Figure 4:
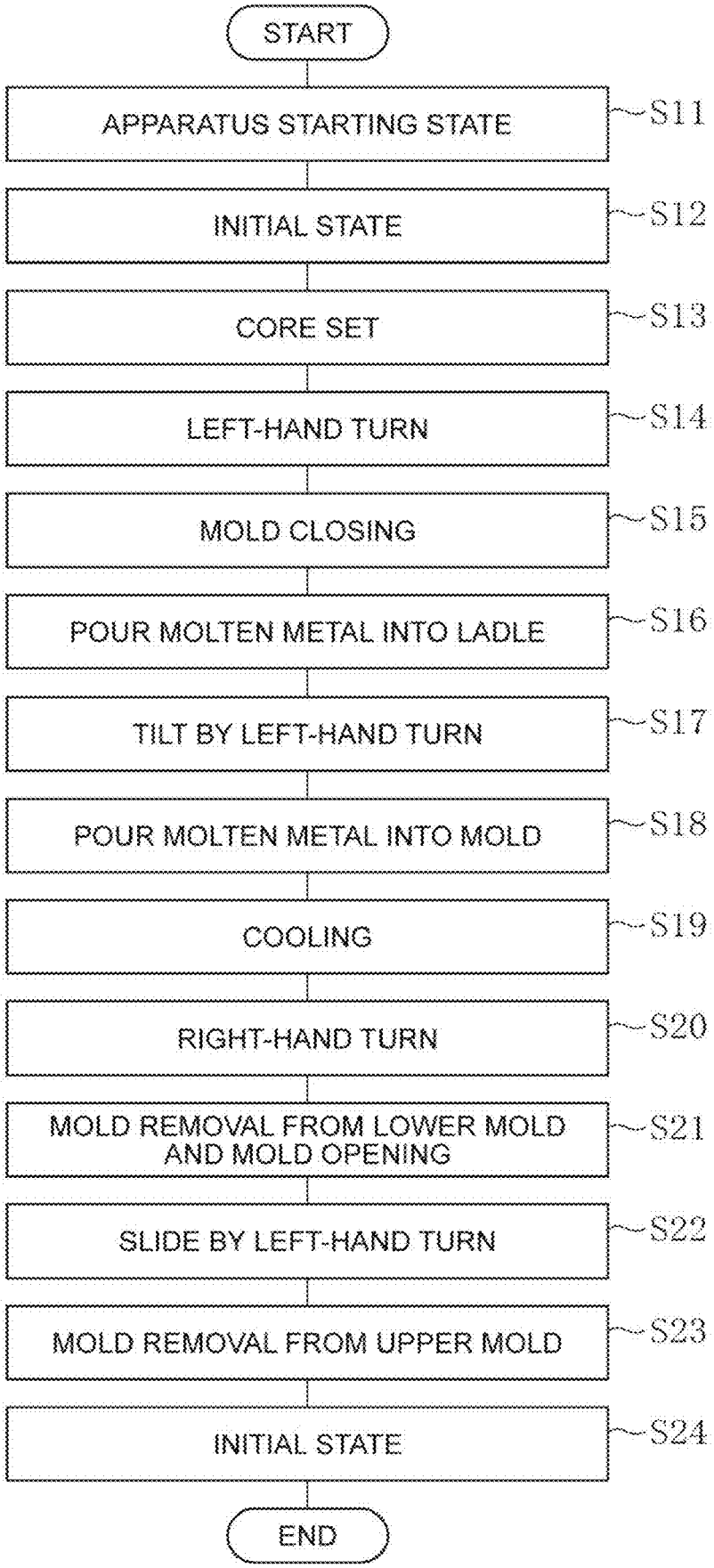
FIG. 4 is a flowchart illustrating a casting method by the casting apparatus in FIG. 1.
Figure 5:
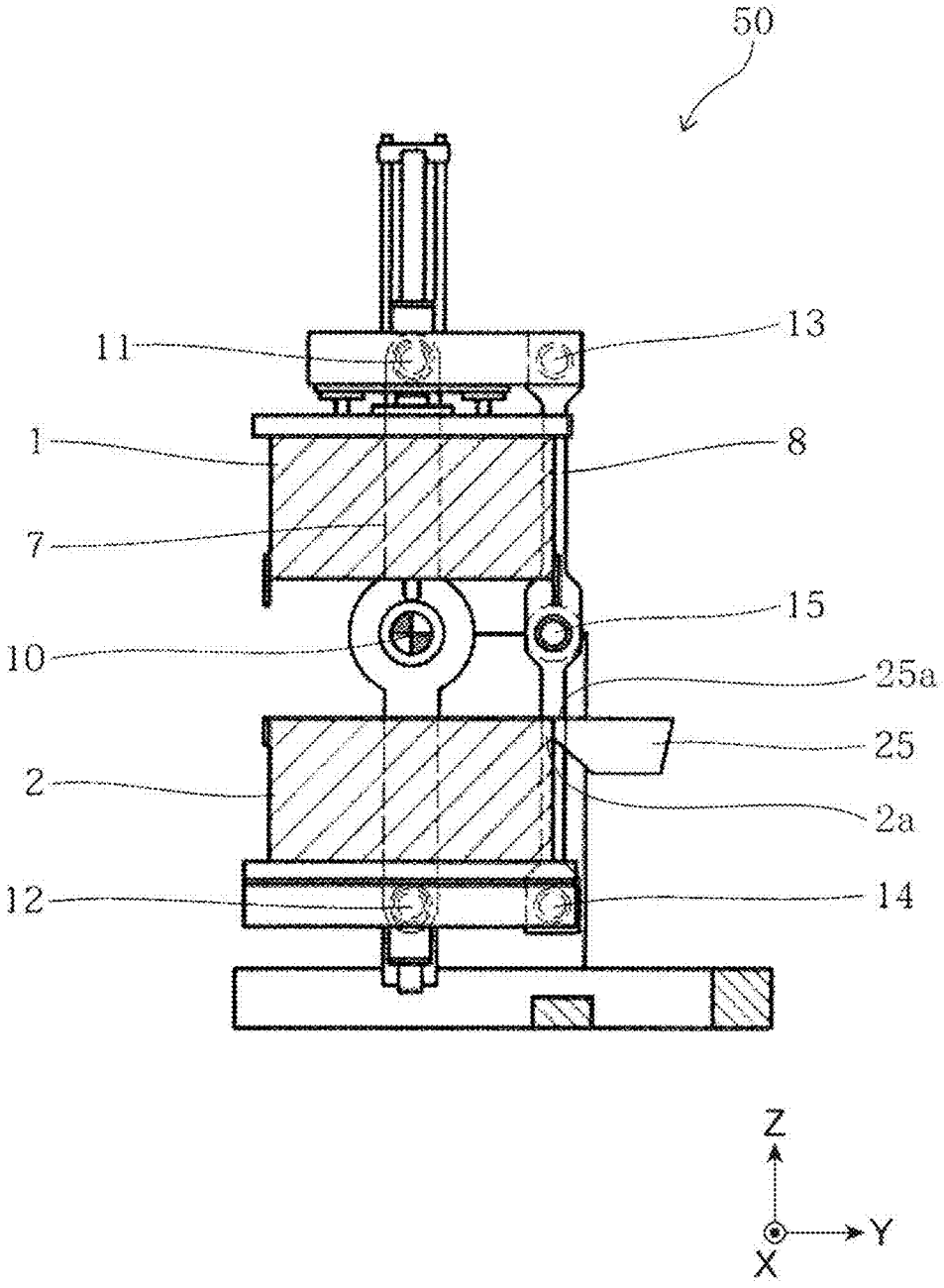
FIG. 5 is a diagram viewed from an arrow direction of a line A-A in FIG. 1 and for describing an apparatus starting state.
Figure 6:
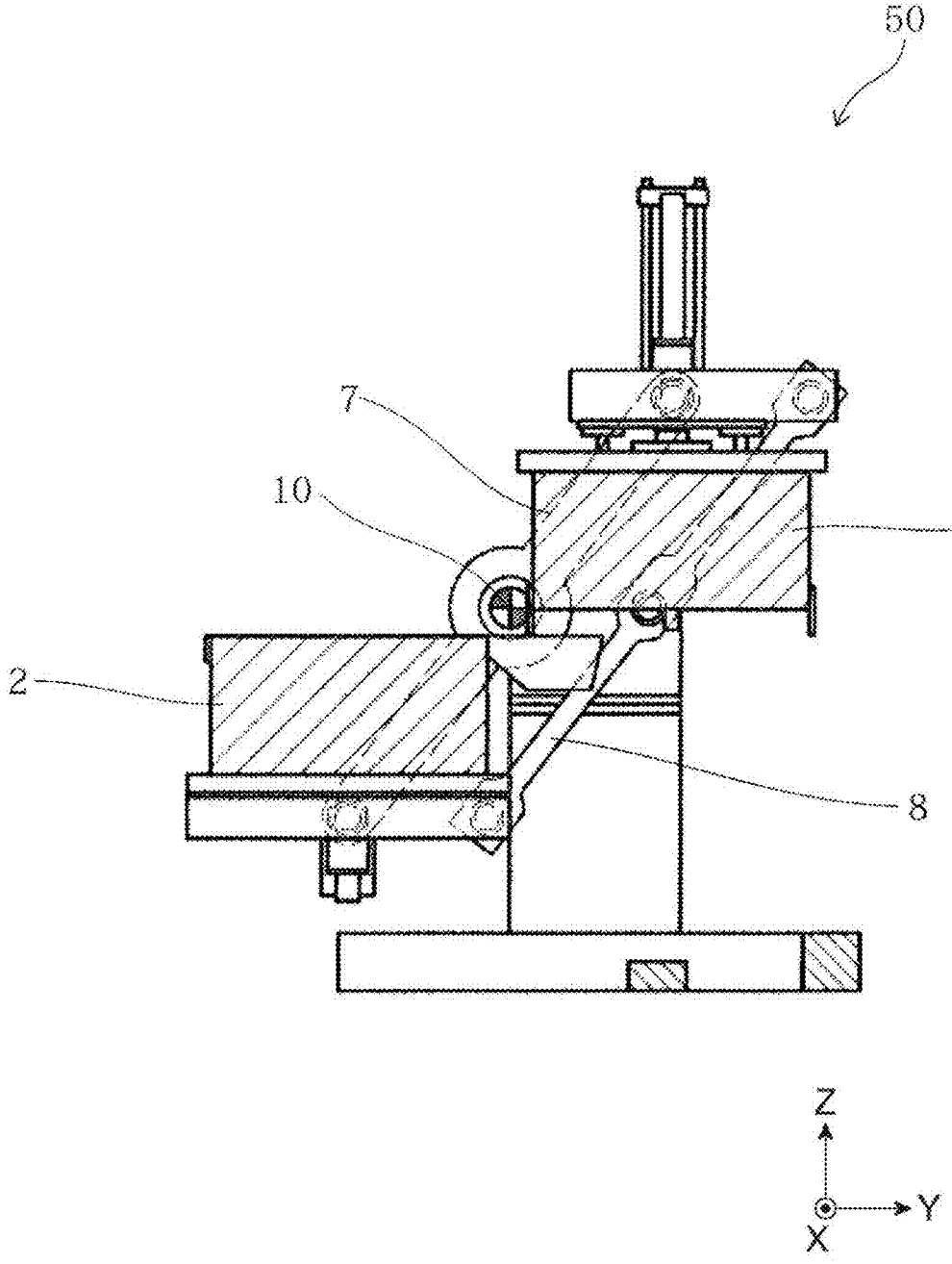
FIG. 6 is a diagram illustrating a second separate state in which upper and lower molds are slid through operation of a parallel link mechanism and describing an initial state of a manufacturing step.
Figure 7:
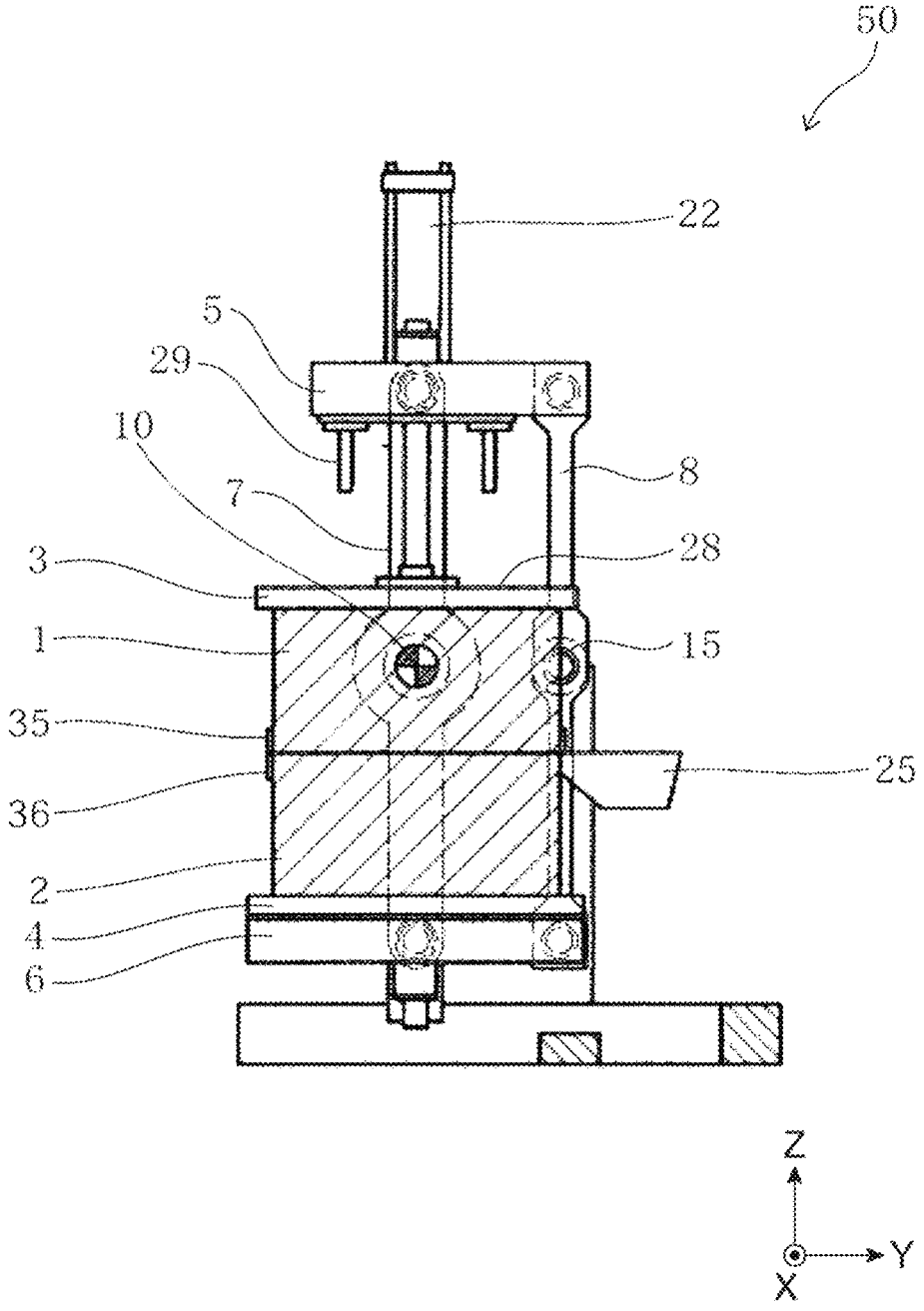
FIG. 7 is a diagram for describing a mold closed state in which the upper mold and the lower mold are closed.
Figure 8:
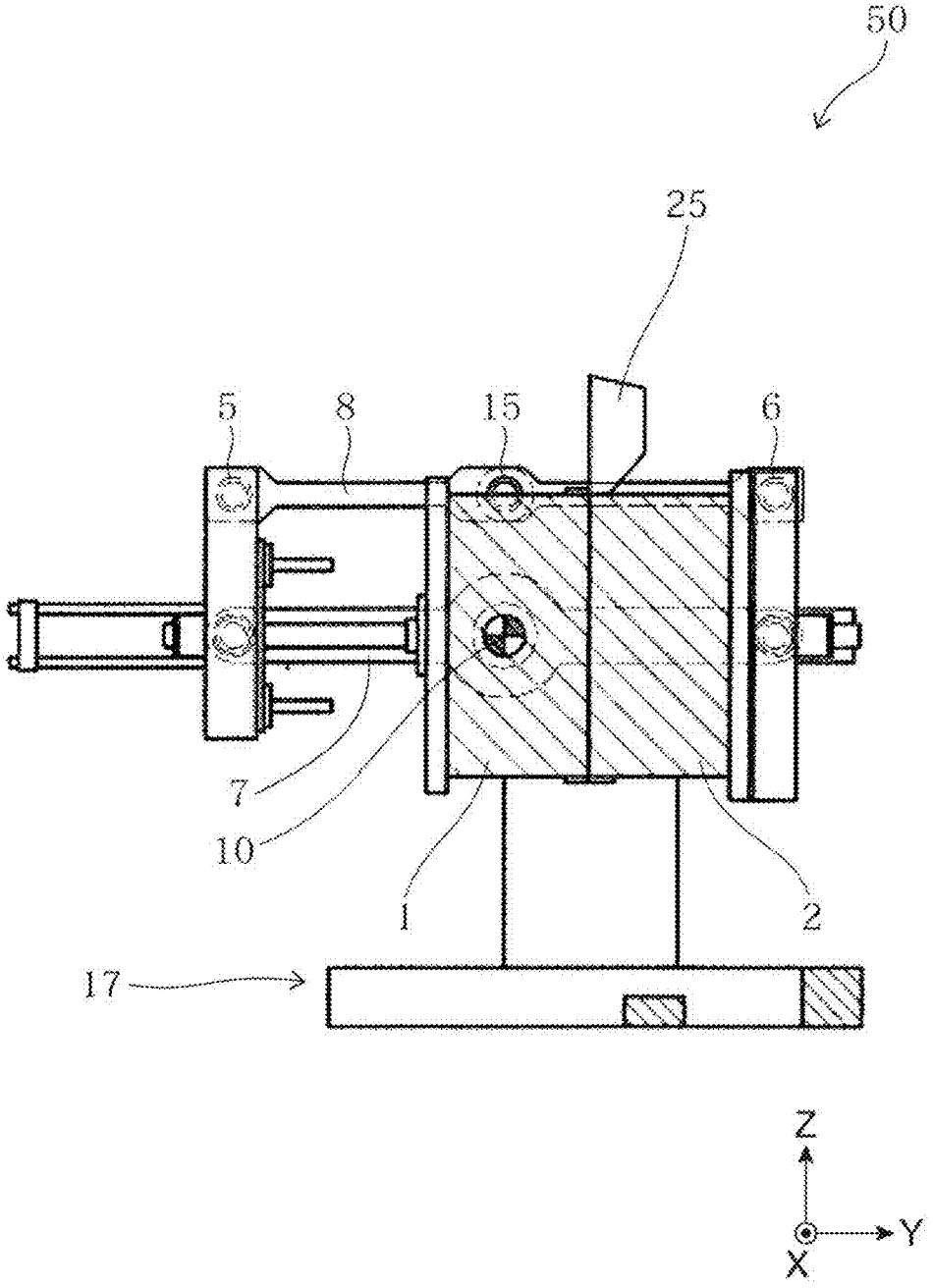
FIG. 8 is a diagram illustrating the closed upper mold and lower mold, tilted by left-hand turn.
Figure 9:
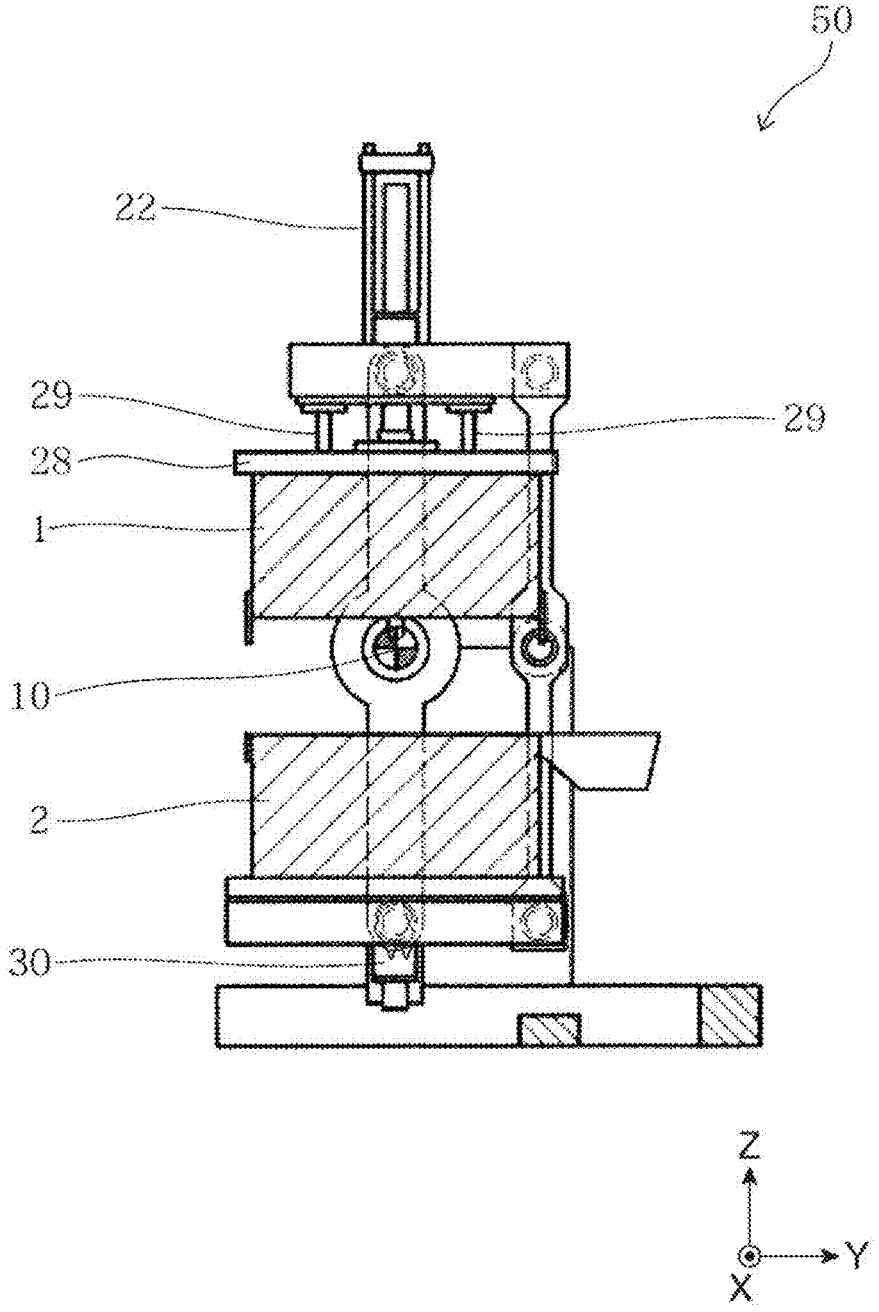
FIG. 9 is a diagram illustrating the upper mold raised up to a midway position.
Figure 10:
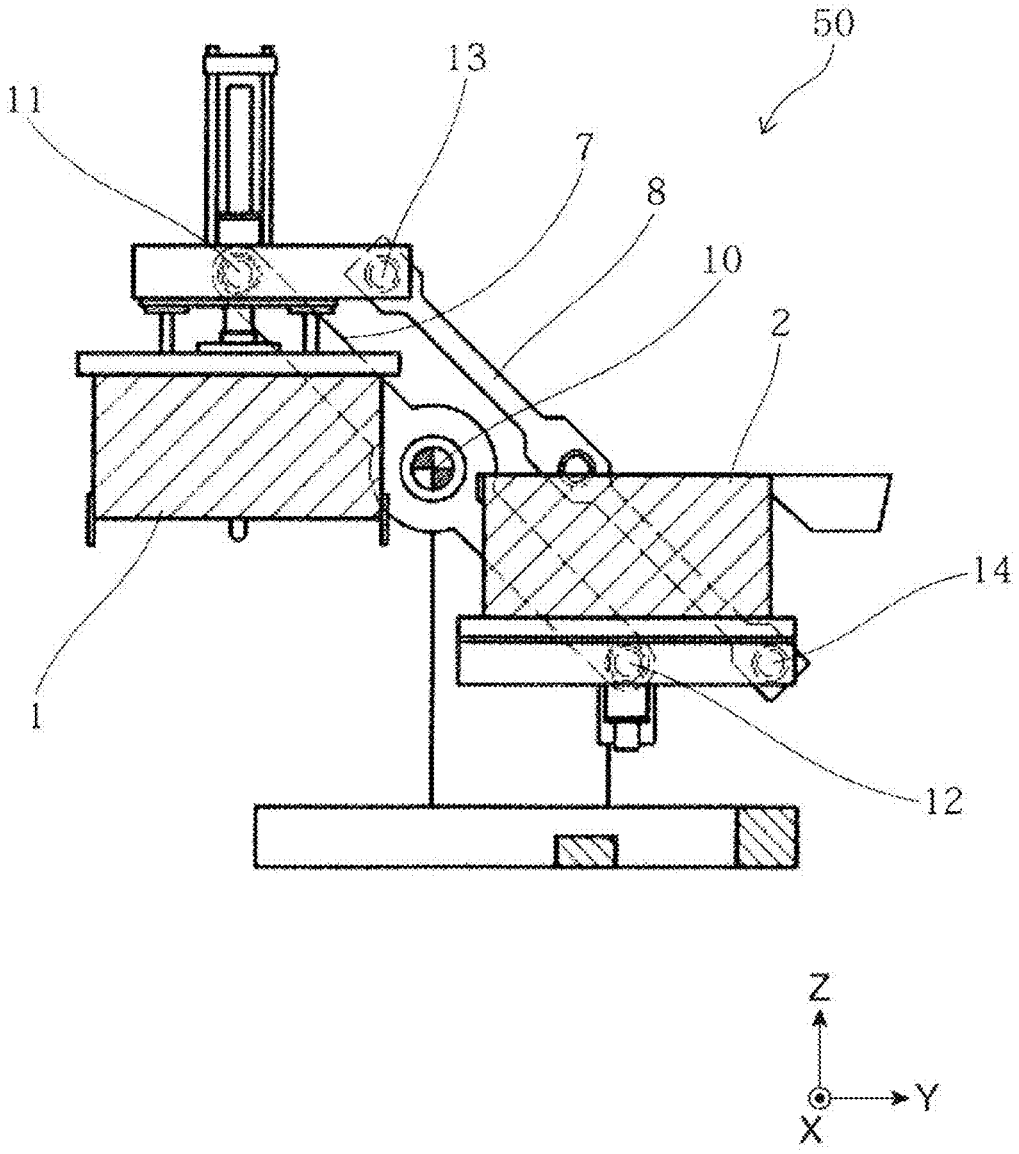
FIG. 10 is a diagram illustrating the upper mold and the lower mold slid into a first separate state.
Figure 11:
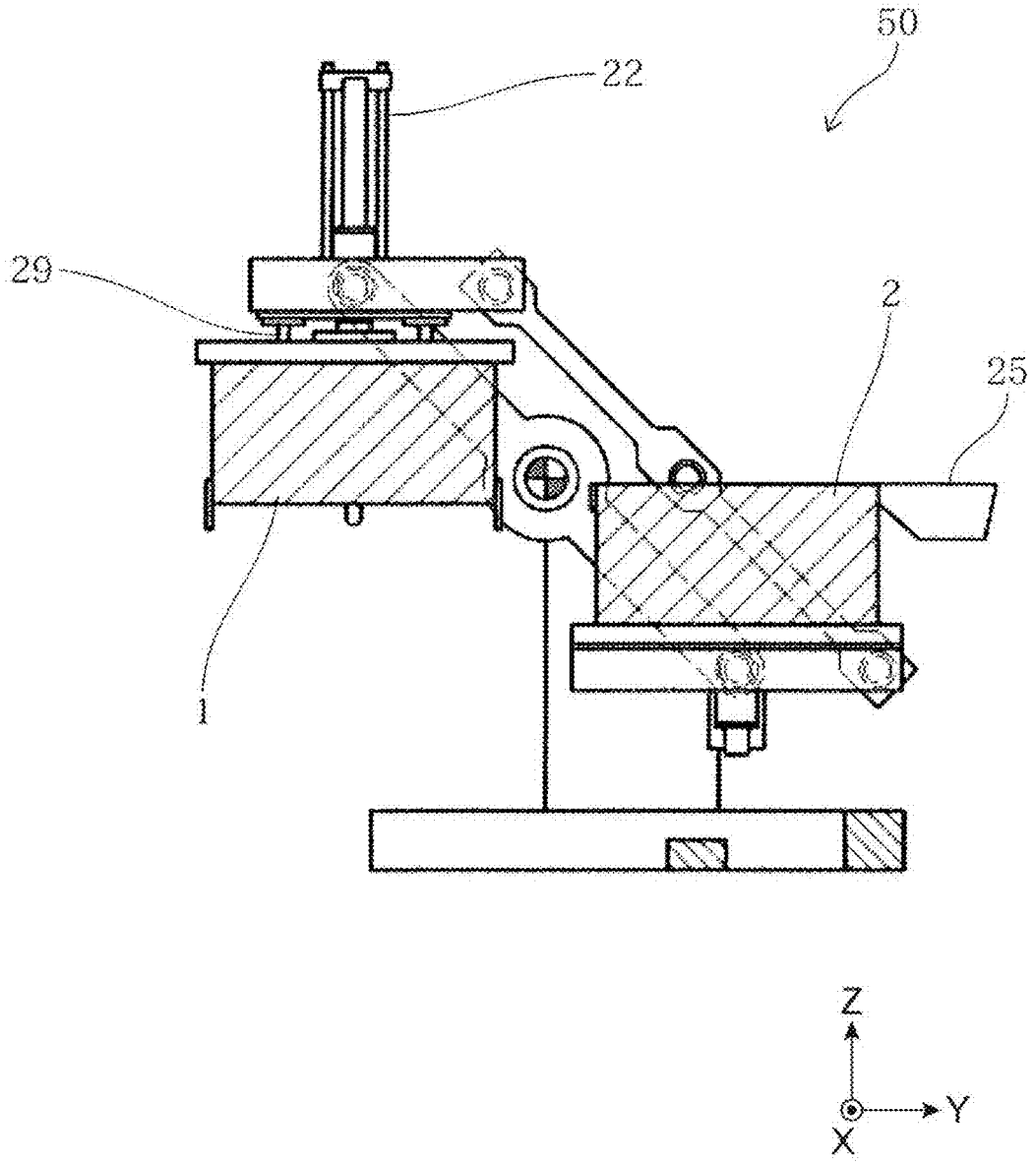
FIG. 11 is a diagram illustrating the upper mold raised from the state in FIG. 10 up to an ascending end.

Next, an example of a casting method using the casting apparatus 50 will be described with reference to FIG. 4 to FIG. 10. FIG. 4 is a flowchart illustrating a casting method by the casting apparatus in FIG. 1. FIG. 5 is a diagram viewed from an arrow direction of a line A-A in FIG. 1 and describing an apparatus starting state. FIG. 6 is a diagram illustrating a second separate state in which upper and lower molds are slid through operation of the parallel link mechanism and describing an initial state of a manufacturing step. FIG. 7 is a diagram for describing a mold closed state in which the upper mold and the lower mold are closed. FIG. 8 is a diagram illustrating the closed upper mold and lower mold, tilted by left-hand turn. FIG. 9 is a diagram illustrating the upper mold lifted up to a midway position. FIG. 10 is a diagram illustrating the upper mold and the lower mold slid into a first separate state. FIG. 11 is a diagram illustrating the upper mold lifted from the state in FIG. 10 up to an ascending end.

As shown in FIG. 4 and FIG. 5, the casting apparatus 50 is in a state in which the upper mold 1 and the lower mold 2 are opened when power is turned on. The upper mold 1 of the casting apparatus 50 is at an ascending end and the pair of main link members 7 and the pair of sub-link members 8 are perpendicular to the installation surface of the casting apparatus 50 (apparatus starting state: step S11).

The casting apparatus 50 is disposed between a workspace (not shown) and a pouring apparatus (not shown). The casting apparatus 50 is disposed such that the ladle 25 faces the pouring apparatus (not shown) in the Y direction. The workspace is a space for the operator to perform a core fitting operation or the like. The pouring apparatus is an apparatus that pours molten metal into the ladle 25. For example, a conveyor (not shown) is disposed between the casting apparatus 50 and the workspace. The conveyor is an apparatus that carries a casting (cast product) cast by the casting apparatus 50. The conveyor extends up to an apparatus in a post-process (e.g., product cooling apparatus, sand shakeout apparatus, product finishing apparatus or the like).

Next, as shown in FIG. 4 and FIG. 6, the casting apparatus 50 is placed into an initial state of a series of casting processes (step S12). The casting apparatus 50 is changed from a state shown in FIG. 5 to an initial state shown in FIG. 6. In step S12, the rotation actuator 16 drives the tilt rotating shaft 10 of the first main link member 7*a* to rotate clockwise. In the present embodiment, a turn in the clockwise direction is assumed to be a right-hand turn and the opposite turn is assumed to be a left-hand turn. Accordingly, the upper mold 1 and the lower mold 2 slide in an arc in opposite directions through action of the parallel link mechanism. More specifically, when the mutually opposing upper mold 1 and lower mold 2 make circular motion of right-hand turn around the tilt rotating shaft 10 as a central axis, and the upper mold 1 and the lower mold 2 move away from each other in the horizontal direction. At this time, the upper mold 1 has moved to the pouring apparatus side (second separate state). This second separate state is an initial state of a series of casting steps. In the present embodiment, the state in which the lower mold 2 has moved to the pouring apparatus side is assumed to be a first separate state and the state in which the upper mold 1 has moved to the pouring apparatus side is assumed to be a second separate state. That is, the first separate state (see FIG. 10) is a state in which the rotation actuator 16 causes the upper mold 1 to move in a direction away from the pouring apparatus and the lower mold 2 to move in a direction approaching the pouring apparatus, whereby the upper mold 1 and the lower mold 2 separate from each other in the horizontal direction. The second separate state (see FIG. 6) is a state in which the rotation actuator 16 causes the upper mold 1 to move in the direction approaching the pouring apparatus and the lower mold 2 to move in a direction away from the pouring apparatus, whereby the upper mold 1 and the lower mold 2 remain separate from each other in the horizontal direction.

Next, the core 34 is fitted in a predetermined position of the lower mold 2 (step S13). Fitting of the core 34 is performed by, for example, the operator. The core 34 is molded using, for example, a core molding machine (not shown). In the second separate state, the lower mold 2 is open upward and the ladle 25 mounted on the lower mold 2 is not in contact with the upper mold 1. Since the lower mold 2 is open upward in this way, the core 34 can be fitted in the lower mold 2 safely.

Next, the casting apparatus 50 causes the rotation actuator 16 to drive the tilt rotating shaft 10 of the first main link member 7*a* to turn counterclockwise and then return to the apparatus starting state in FIG. 5 (step S14). Next, as shown in FIG. 4 and FIG. 7, the casting apparatus 50 extends the first hydraulic actuator 22 to close the upper mold 1 and the lower mold 2 (step S15). At this time, the positioning key 35 of the upper mold 1 engages with the key groove 36 of the lower mold 2, and the upper mold 1 and the lower mold 2 are fixed in the horizontal direction. Furthermore, mold closing prevents rotations of the pair of main link members 7 and the pair of sub-link members 8, the main link upper rotating shaft 11, the main link lower rotating shaft 12, the sub-link upper rotating shaft 13 and the sub-link lower rotating shaft 14, which integrates the upper mold 1, the lower mold 2, the upper frame 5, the lower frame 6, the pair of main link members 7 and the pair of sub-link members 8 together.

Next, when the upper mold 1 and the lower mold 2 are closed, that is, in a mold-closed state, the pouring apparatus supplies molten metal into the ladle 25 (step S16). Next, as shown in FIG. 4 and FIG. 8, the casting apparatus 50 causes the rotation actuator 16 to drive the tilt rotating shaft 10 of the first main link member 7*a* to make a left-hand turn by approximately 90° to bring the upper mold 1 and the lower mold 2 into a tilted state (step S17). This causes the fixing member 41 (see FIG. 2) to lift from the top surface of the base frame 17 on which the fixing member 41 has been placed. Accordingly, the closed and integrated upper mold 1, lower mold 2, upper frame 5, lower frame 6, pair of main link members 7 and pair of sub-link members 8 rotate and the molten metal in the ladle 25 is tilted and poured into the cavity formed between the upper mold 1 and the lower mold 2 (step S18).

After the process in the step S18 ends, the state in FIG. 8 is kept for a predetermined time, waiting for the poured molten metal to coagulate (cool) (step S19). As described above, the rotation actuator 16 is caused to drive the tilt rotating shaft 10 of the first main link member 7*a* to turn counterclockwise by approximately 90°, but the tilt rotating shaft 10 may also be caused to turn by a predetermined angle within a range of 45° to 130° or 45° to 90°.

Next, the casting apparatus 50 causes the rotation actuator 16 to drive the tilt rotating shaft 10 of the first main link member 7*a* to make a right-hand turn and returns to the state in FIG. 7 (step S20). Next, mold removal and mold opening from the lower mold 2 are simultaneously performed (step S21). Mold opening is performed as shown in FIG. 4 and FIG. 9 and mold removal from the lower mold 2 is also performed simultaneously. Mold opening is started by the casting apparatus 50 operating the first hydraulic actuator 22. Extending operation of the second hydraulic actuator 30 starts simultaneously with the contracting operation of the first hydraulic actuator 22. When the second hydraulic actuator 30 extends, the pushing out pin 26 (see FIG. 3) incorporated in the lower mold 2 is pushed out. This causes the casting (not shown) consisting of coagulated molten metal in the upper mold 1 and the lower mold 2 to be removed from the lower mold 2 and remain held to the upper mold 1. The casting apparatus 50 causes the upper mold 1 to move up to a predetermined position and mold opening is completed. The predetermined position is a position where the distal end of the push rod 29 is not in contact with the top surface of the pushing out plate 28 of the upper mold 1. In other words, the predetermined position is a position where there is a gap between the distal end of the push rod 29 and the top surface of the pushing out plate 28 of the upper mold 1.

Next, as shown in FIG. 4 and FIG. 10, the casting apparatus 50 causes the rotation actuator 16 to drive the tilt rotating shaft 10 of the first main link member 7*a* to turn counterclockwise (step S22). Through the action of the parallel link mechanism, the casting apparatus 50 causes the upper mold 1 and the lower mold 2 to slide in an arc and separates them apart in the horizontal direction. At this time, a state in which the upper mold 1 has moved to the conveyor side, that is, a first separate state in which the lower mold 2 has moved in a direction approaching the pouring apparatus. The angle of left-hand turn of the rotation actuator 16 at this time becomes on the order of 30° to 45° at which the upper mold 1 is opened downward.

Next, as shown in FIG. 4 and FIG. 11, the casting apparatus 50 contracts the first hydraulic actuator 22 to move the upper mold 1 up to an ascending end. In this way, the distal end of the push rod 29 relatively pushes out the pushing out pin 26 (see FIG. 3) with respect to the upper mold 1 via the pushing out plate 28 incorporated in the upper mold 1. As a result, the casting held to the upper mold 1 is removed from the upper mold 1 (step S23). The casting removed from the upper mold 1 drops and is received by the conveyor provided below the upper mold 1. That is, the conveyor functions as a receiver receiving the casting as well. After that, the casting is carried by the conveyor to, for example, a product cooling apparatus, a sand shakeout apparatus and a product finishing apparatus carrying out deburring or the like.

Next, as shown in FIG. 4, the casting apparatus 50 causes the rotation actuator 16 to drive the tilt rotating shaft 10 of the first main link member 7*a* to turn clockwise (step S22). In this way, the casting apparatus 50 returns to the initial state (see FIG. 7). As described above, a series of casting processes are completed and a casting is cast by the casting apparatus 50. When the casting processes are consecutively performed, castings can be cast consecutively by repeating processes from the core setting process in step S13.

Figure 12:
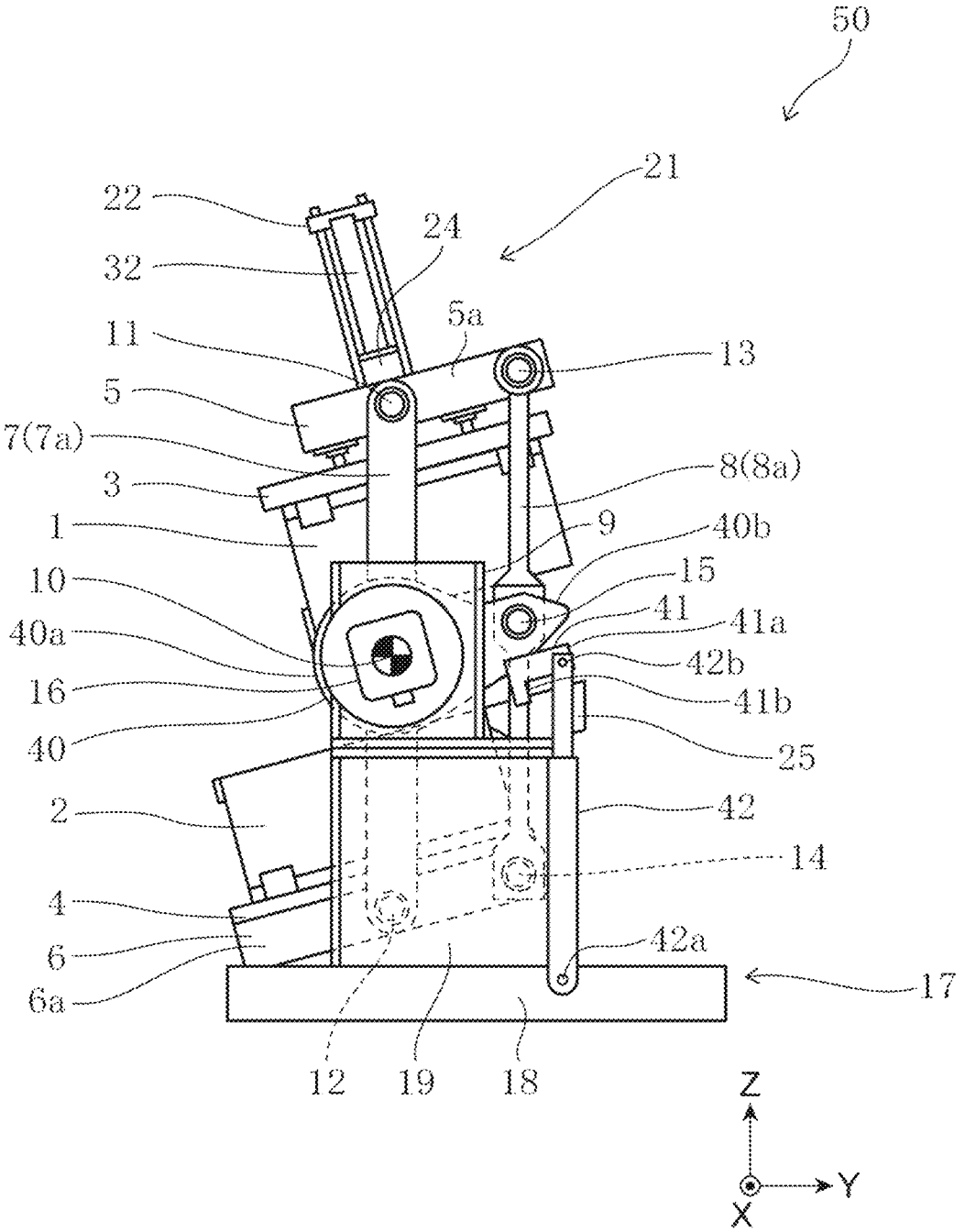
FIG. 12 is a diagram illustrating the first sub-link member lifted from the state in FIG. 2.
Figure 13:
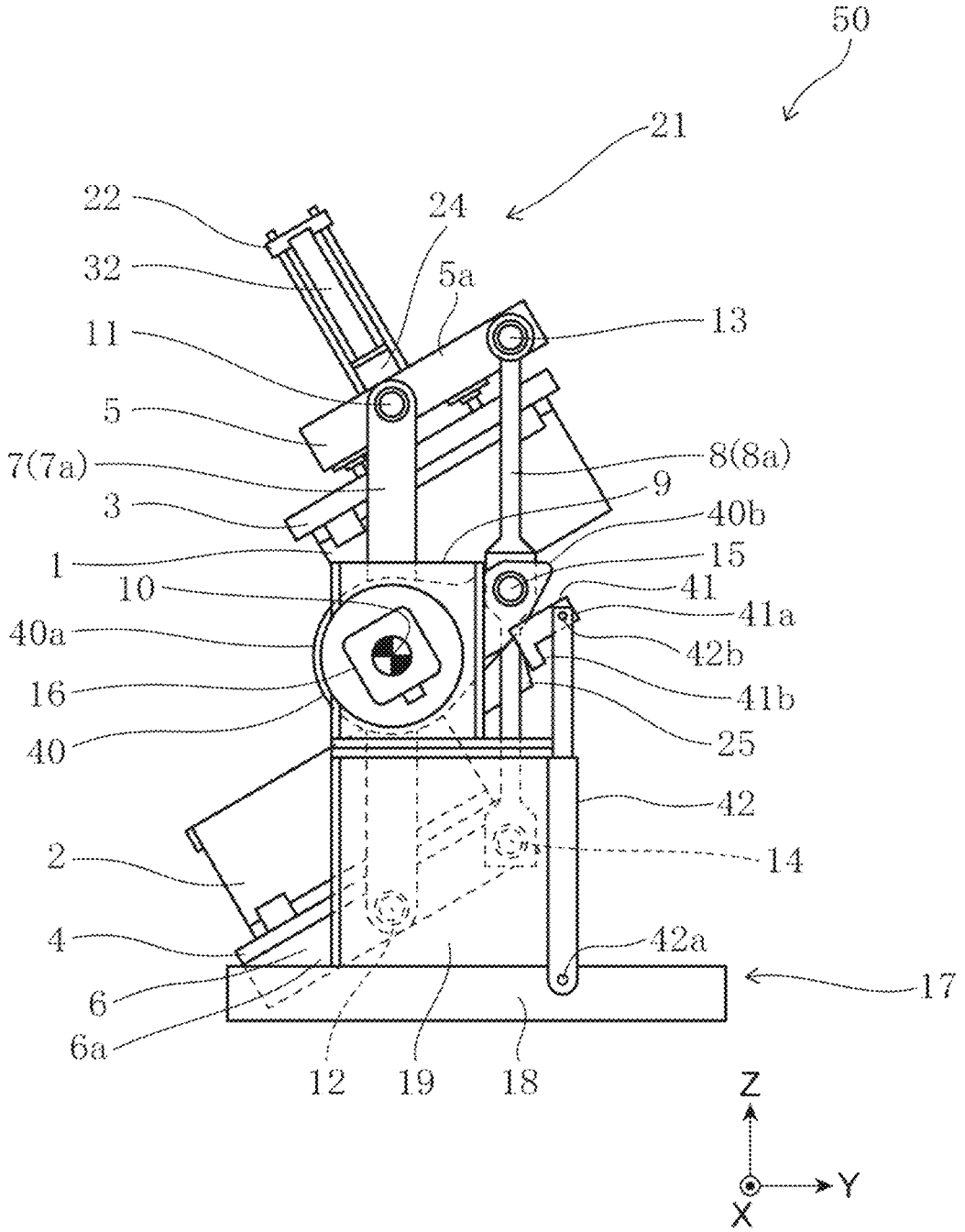
FIG. 13 is a diagram illustrating the first sub-link member further lifted from the state in FIG. 11.

Next, operation of the lifting/lowering mechanism 42 will be described with reference to FIG. 2, FIG. 12 and FIG. 13. FIG. 12 is a diagram illustrating the first sub-link member lifted from the state in FIG. 2. FIG. 13 is a diagram illustrating the first sub-link member further lifted from the state in FIG. 11.

When the first sub-link member 8*a* is lifted as shown in FIG. 12 and FIG. 13 from the state in which the first main link member 7*a* and the first sub-link member 8*a* are at the same height position as shown in FIG. 2, the lifting/lowering mechanism 42 extends the hydraulic cylinder to apply an upward force to the second part 40*b* via the fixing member 41. In this way, the fixing member 41 is lifted from the top surface of the base frame 17 on which the fixing member 41 has been placed. As a result, the second part 40*b* and the sub-link central part rotating shaft 15 attached to the second part 40*b* make a left-hand turn around the tilt rotating shaft 10 attached to the first part 40*a*. Since the rotating shaft 42*a* is provided at the bottom end part of the lifting/lowering mechanism 42, the lifting/lowering mechanism 42 extends the hydraulic cylinder while slightly making a left-hand turn around the rotating shaft 42*a* in accordance with the left-hand turn of the sub-link central part rotating shaft 15.

In this way, the lifting/lowering mechanism 42 causes the second part 40*b* and the sub-link central part rotating shaft 15 to rotate around the tilt rotating shaft 10 to thereby cause the first sub-link member 8*a* to lift with respect to the first main link member 7*a*. This causes the first parallel link mechanism to act. The sub-link upper rotating shaft 13 lifts with respect to the main link upper rotating shaft 11 and the sub-link lower rotating shaft 14 lifts with respect to the main link lower rotating shaft 12. At this time, the second parallel link mechanism also acts in accordance with the first parallel link mechanism. As a result, the upper frame 5 and the lower frame 6 are tilted. As a consequence, the upper mold 1 and the lower mold 2 attached to the upper frame 5 and the lower frame 6, respectively, are tilted. The angle of rotation of the sub-link central part rotating shaft 15 is 15° in FIG. 12 and 30° in FIG. 13.

When the first sub-link member 8*a* is lowered as shown in FIG. 2 from a state in which the first sub-link member 8*a* is at a position above the first main link member 7*a* as shown in FIG. 12 and FIG. 13, the lifting/lowering mechanism 42 causes the hydraulic cylinder to contract to thereby apply a downward force to the second part 40*b* via the fixing member 41. In this way, the sub-link central part rotating shaft 15 makes a right-hand turn around the tilt rotating shaft 10 and the lifting/lowering mechanism 42 causes the hydraulic cylinder to contract while slightly making a right-hand turn around the rotating shaft 42*a*. Thus, the lifting/lowering mechanism 42 causes the second part 40*b* and the sub-link central part rotating shaft 15 to rotate around the tilt rotating shaft 10 to thereby lower the first sub-link member 8*a* with respect to the first main link member 7*a*. When the first parallel link mechanism and the second parallel link mechanism act, the upper frame 5 and the lower frame 6 come to oppose each other in the vertical direction (Z direction).

In the casting apparatus 50, maintenance work on the upper mold 1 and the lower mold 2 is carried out periodically. The maintenance work may be performed every predetermined number of times (e.g., 10 times) a casting is cast. The maintenance work may also be performed every predetermined time (e.g., 30 minutes) during which a casting is cast. In the maintenance work, for example, inspections of the upper mold 1 and the lower mold 2, cleaning and coating are performed. The maintenance work on the lower mold 2 may be performed, for example, in a second separate state shown in FIG. 6. In the second separate state, since the upper part of the lower mold 2 is open, an operator can easily perform maintenance work on the lower mold 2. In the second separate state, the lower part of the upper mold 1 is open. However, in the second separate state, the operator needs to slip into a space under the upper mold 1.

The casting apparatus 50 is provided with the lifting/lowering mechanism 42 lifting or lowering the first sub-link member 8*a* with respect to the first main link member 7*a*. By operating the lifting/lowering mechanism 42 as described above, the upper frame 5 and the lower frame 6 can be tilted. This allows the upper mold 1 and the lower mold 2 attached to the upper frame 5 and the lower frame 6 respectively to be tilted. Therefore, as shown, for example, in FIG. 5, it is possible to facilitate maintenance work on the upper mold 1 and the lower mold 2 by operating the lifting/lowering mechanism 42 with the upper mold 1 and the lower mold 2 opened and by tilting the upper mold 1 and the lower mold 2.

The casting apparatus 50 is further provided with the rotation actuator 16 connected to the first main link member 7*a* and causing the first main link member 7*a* to rotate. For this reason, when the lifting/lowering mechanism 42 lifts or lowers the first main link member 7*a* to which the rotation actuator 16 is connected, it is necessary to lift or lower the rotation actuator 16 together with the first main link member 7*a*. Since the lifting/lowering mechanism 42 lifts or lowers the first sub-link member 8*a*, the casting apparatus 50 can reduce the load on the lifting/lowering mechanism 42 compared to the case where the first main link member 7*a* is lifted or lowered.

The casting apparatus 50 is further provided with the bracket 40 including the first part 40*a* rotatably connected to the central part of the first main link member 7*a* and the second part 40*b* rotatably connected to the central part of the first sub-link member 8*a*. This improves strength of the first parallel link mechanism constructed of the first main link member 7*a*, the first sub-link member 8*a*, the upper frame 5 and the lower frame 6. The first main link member 7*a* includes the tilt rotating shaft 10 at the central part thereof. The first part 40*a* is rotatably connected to the tilt rotating shaft 10. The lifting/lowering mechanism 42 is connected to the second part 40*b*, causes the second part 40*b* to rotate around the tilt rotating shaft 10 and thereby causes the first sub-link member 8*a* to lift or lower with respect to the first main link member 7*a*. In this way, a force of the lifting/lowering mechanism 42 is directly given to the bracket 40, and so the second part 40*b* of the bracket 40 can be rotated stably.

Second Embodiment

Figure 14:
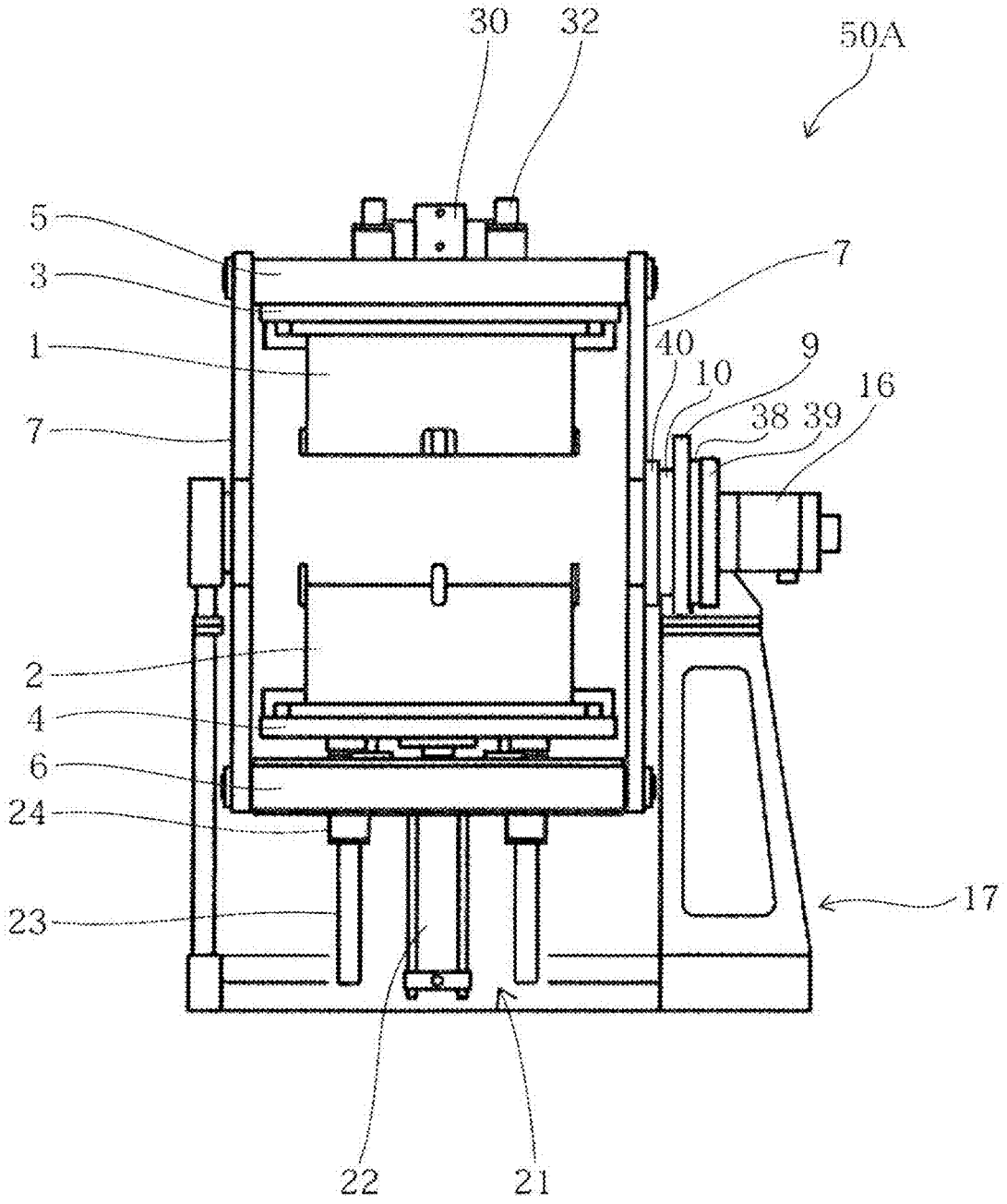
FIG. 14 is a front view of a casting apparatus according to a second embodiment.

FIG. 14 is a front view of a casting apparatus according to a second embodiment. As shown in FIG. 14, a casting apparatus 50A according to the second embodiment is different from the casting apparatus 50 according to the first embodiment mainly in that the opening/closing mechanism 21 moving the lower mold 2 up and down is provided in the lower frame 6. The opening/closing mechanism 21 is provided on the lower frame 6. Accordingly, the lower mold 2 in a casting apparatus 50A can move up and down. Hereinafter, differences between the casting apparatus 50A according to the second embodiment and the casting apparatus 50 according to the first embodiment will be described mainly and common description thereof will be omitted.

Figure 15:
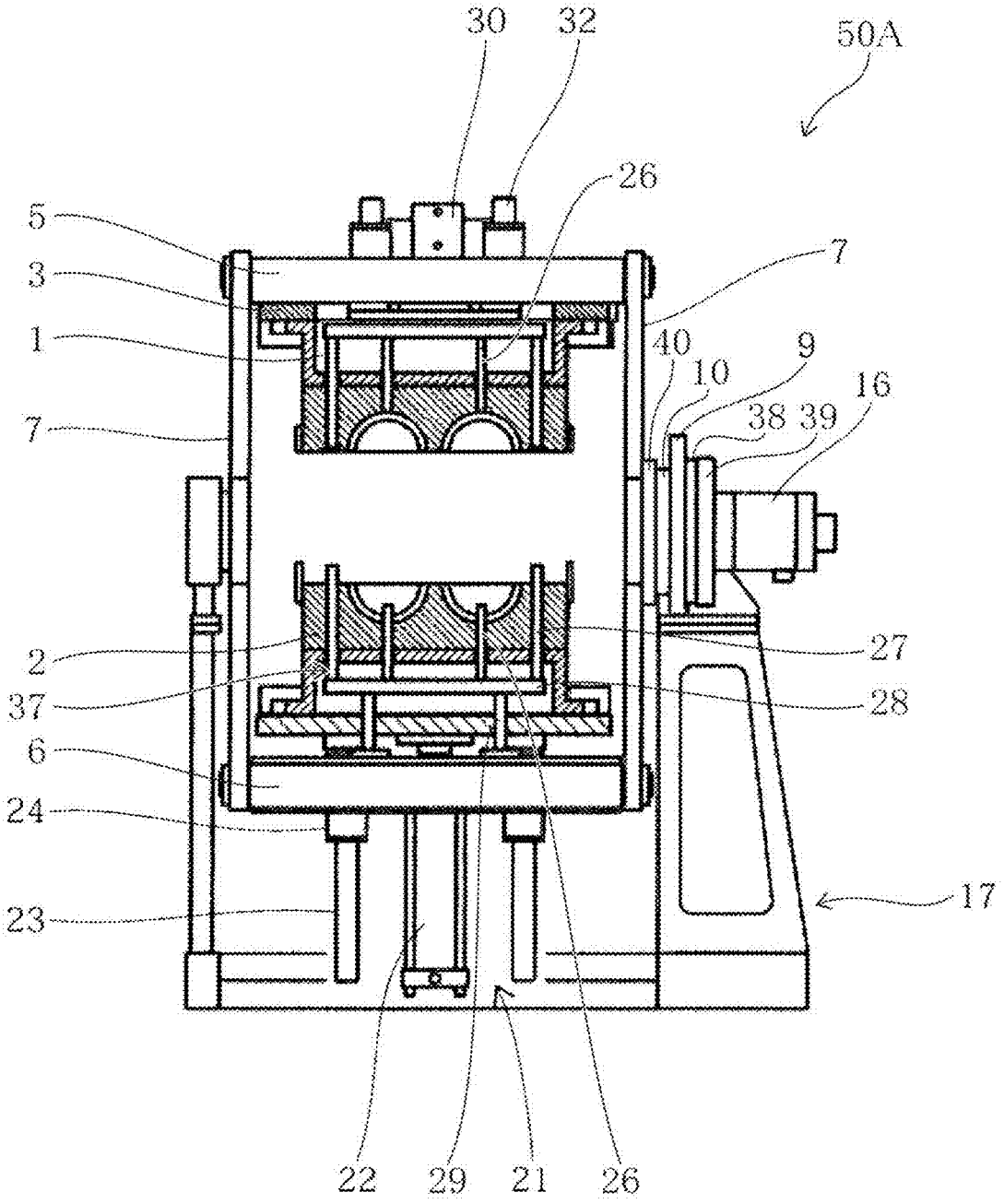
FIG. 15 is a diagram illustrating a cross section of an upper mold and a lower mold in FIG. 14.

FIG. 15 is a diagram illustrating cross sections of the upper die and the lower die in FIG. 14. As shown in FIG. 15, in the casting apparatus 50A, the second hydraulic actuator 30 is provided in the upper frame 5 and the pushing out mechanism 37 is provided in the lower frame 6. In the casting apparatus 50A, the pushing out plate 28 is disposed in an inner space formed in the interior on the bottom end side of the lower mold 2. Each pushing out pin 26 is provided on the top surface of the pushing out plate 28. Each pushing out pin 26 moves up and down through a hole from the inner space of the lower mold 2 to a cavity in which a casting is formed. A distal end of each pushing out pin 26 pushes out the casting in the cavity. Each return pin 27 is provided at a position different from the pushing out pin 26 at the top surface of the pushing out plate 28. Each return pin 27 moves up and down through the hole from the inner space of the lower mold 2 to the top surface of the lower mold 2. In a process in which the upper mold 1 and the lower mold 2 are closed, the distal end of each return pin 27 is abutted against the undersurface of the upper mold 1 to thereby cause the pushing out plate 28 to move down.

Each push rod 29 is provided on the top surface of the lower frame 6. Each push rod 29 is disposed on the top surface of the lower frame 6 by penetrating the lower mold die base 4. Each push rod 29 is inserted into a hole penetrating from the undersurface of the lower mold 2 to the inner space and the distal end of each push rod 29 is disposed below the pushing out plate 28 in the inner space. The length of each push rod 29 is set to a length that the pushing out plate 28 is pushed up when the first hydraulic actuator 22 is contracted and the lower mold 2 becomes a descending end. That is, each push rod 29 passes through the hole penetrating an inner space formed at a lower position of the lower mold 2 from the undersurface of the lower mold 2 and enters the inner space by a predetermined length to prevent the pushing out plate 28 from moving down. The rest of the configuration is identical to the configuration of the casting apparatus 50 according to the first embodiment.

According to the casting method for the casting apparatus 50A, in the step S21, mold removal from the upper mold 1 and mold opening are performed in parallel. More specifically, the casting apparatus 50A causes the lower mold 2 to move down through the opening/closing mechanism 21 provided in the lower frame 6 and starts mold opening of the upper mold 1 and the lower mold 2. Simultaneously with this, the casting apparatus 50A starts extending operation of the second hydraulic actuator 30 provided in the upper frame 5. Extension of the second hydraulic actuator 30 causes the pushing out pin 26 incorporated in the upper mold 1 to be pushed out. In this way, a casting (not shown) made of molten metal coagulating in the upper mold 1 and the lower mold 2 is removed from the upper mold 1 and held to the lower mold 2. In above process S23, mold removal from the lower mold 2 is performed. More specifically, the opening/closing mechanism 21 causes the lower mold 2 to move down to a descending end. Thus, the distal end of the push rod 29 relatively pushes out the pushing out pin 26 with respect to the lower mold 2 via the pushing out plate 28 incorporated in the lower mold 2. As a result, the casting held to the lower mold 2 is removed from the lower mold 2.

The casting apparatus 50A exerts effects similar to the effects of the aforementioned casting apparatus 50.

The respective embodiments have been described so far, but the present disclosure is not limited to the above respective embodiments. For example, the casting apparatus 50 may also be provided with another lifting/lowering mechanism 42 lifting or lowering the second sub-link member 8*b* with respect to the second main link member 7*b*.

The lifting/lowering mechanism 42 is required to have a configuration that at least allows the first sub-link member 8*a* to relatively lift or lower with respect to the first main link member 7*a*. Therefore, although the lifting/lowering mechanism 42 actually lifts or lowers the first sub-link member 8*a* in the casting apparatus 50 or 50At, the lifting/lowering mechanism 42 may be configured to actually lift or lower the first main link member 7*a*.

In the casting apparatus 50 or 50A, the lifting/lowering mechanism 42 is connected to the second part 40*b* of the bracket 40, but the lifting/lowering mechanism 42 may be connected to the sub-link upper rotating shaft 13 and the sub-link lower rotating shaft 14 or the like. The lifting/lowering mechanism 42 may be directly connected to the bracket 40 not through the fixing member 41.

Instead of the second hydraulic actuator 30 removing a casting from the upper mold 1 or the lower mold 2, the pushing out plate 28 may be pushed out using a spring. In that case, when the upper mold 1 and lower mold 2 are closed, the upper mold 1 pushes down the return pins 27 of the lower mold 2 to push down the pushing out pins 26. For this reason, although the mold closing force is offset by a pushing-down force of the return pin 27, the number of actuators can be reduced.

A plurality of casting apparatuses 50 may be disposed. At this time, there is no limit to an arrangement of the casting apparatus as long as the pouring apparatus can pour molten metal. The core may be fitted not only by the operator but also by a core fitting robot provided with articulated arms. The opening/closing mechanism 21 may cause both the upper mold 1 and the lower mold 2 to move up and down.

REFERENCE SIGNS LIST

1 . . . upper mold, 2 . . . lower mold, 5 . . . upper frame, 6 . . . lower frame, 7 . . . main link members, 7*a* . . . first main link member, 8 . . . sub-link members, 8*a* . . . first sub-link member, 10 . . . tilt rotating shaft, 16 . . . rotation actuator (drive unit), 40 . . . bracket (connection member), 40*a* . . . first part, 40*b* . . . second part, 42 . . . lifting/lowering mechanism, 50, 50A . . . casting apparatus

The invention claimed is:

1. A casting apparatus forming a casting by using openable/closable/tiltable upper and lower molds, with molten metal being poured into the casting apparatus by using gravity, the casting apparatus comprising:

an upper frame to which the upper mold is attached;

a lower frame disposed in parallel with the upper frame and to which the lower mold is attached;

a main link member, a top end part of which is rotatably connected to the upper frame and a bottom end part of which is rotatably connected to the lower frame;

a sub-link member disposed in parallel with the main link member, a top end part of which is rotatably connected to the upper frame and a bottom end part of which is rotatably connected to the lower frame; and a lifting/lowering mechanism causing the sub-link member to lift or lower with respect to the main link member.

2. The casting apparatus according to claim 1, further comprising a drive unit connected to the main link member and causing the main link member to rotate.

3. The casting apparatus according to claim 1, further comprising a connection member including a first part and a second part, wherein the main link member includes a tilt rotating shaft at a central part of the main link member, the first part is rotatably connected to the tilt rotating shaft, the second part is rotatably connected to the central part of the sub-link member, and the lifting/lowering mechanism is connected to the second part to cause the second part to rotate around the tilt rotating shaft and thereby lift or lower the sub-link member with respect to the main link member.

4. The casting apparatus according to claim 2, further comprising a connection member including a first part and a second part, wherein the main link member includes a tilt rotating shaft at a central part of the main link member, the first part is rotatably connected to the tilt rotating shaft, the second part is rotatably connected to the central part of the sub-link member, and the lifting/lowering mechanism is connected to the second part to cause the second part to rotate around the tilt rotating shaft and thereby lift or lower the sub-link member with respect to the main link member.

* * * * *